US006986722B2

(12) United States Patent
Dadbeh

(10) Patent No.: US 6,986,722 B2
(45) Date of Patent: Jan. 17, 2006

(54) COMPACT COLLAPSIBLE TENNIS TABLE

(75) Inventor: Benanali H. Dadbeh, Encinitas, CA (US)

(73) Assignee: SOP Services, Inc., Las Vegas, NV (US)

( * ) Notice: Subject to any disclaimer, the term of this patent is extended or adjusted under 35 U.S.C. 154(b) by 521 days.

(21) Appl. No.: 10/134,902

(22) Filed: Apr. 29, 2002

(65) Prior Publication Data

US 2002/0119844 A1 Aug. 29, 2002

Related U.S. Application Data

(63) Continuation of application No. 09/561,884, filed on May 1, 2000, now abandoned.

(51) Int. Cl.

| | |
|---|---|
| ***A63B 67/04*** | (2006.01) |
| ***A63B 71/04*** | (2006.01) |
| ***A47B 57/00*** | (2006.01) |
| ***A47B 1/06*** | (2006.01) |
| ***A47B 3/083*** | (2006.01) |

(52) U.S. Cl. ..... 473/496; 108/64; 108/67; 108/99; 108/168

(58) Field of Classification Search ..... 473/473, 473/475, 422, 490–496, FOR 112, FOR 113; 108/29, 63, 64, 67, 99, 167–172
See application file for complete search history.

(56) References Cited

U.S. PATENT DOCUMENTS

| | | | |
|---|---|---|---|
| 737,455 | A | 8/1903 | Noble |
| 834,461 | A | 10/1906 | Fair |
| 952,408 | A | 3/1910 | Baugh |
| 2,569,077 | A | 9/1951 | Schneider |
| 2,901,304 | A | 8/1959 | Fihe |
| 3,190,649 | A | 6/1965 | Heisler |
| 3,229,790 | A | 1/1966 | Shayne |
| 3,267,885 | A | 8/1966 | Shore |
| 3,318,269 | A | 5/1967 | Kinn |
| 3,342,149 | A | 9/1967 | Kruissink |
| 3,503,525 | A | 3/1970 | Loebner |
| 3,525,492 | A | 8/1970 | Friedman et al. |
| 3,661,100 | A | 5/1972 | Tennant |

(Continued)

FOREIGN PATENT DOCUMENTS

| | | |
|---|---|---|
| WO | 99/02220 | 1/1999 |

OTHER PUBLICATIONS

SportCraft Table Tennis Table Assembly Instructions & Rules (Model 18-0855); see marked up pages.*

(Continued)

*Primary Examiner*—Mitra Aryanpour
(74) *Attorney, Agent, or Firm*—Woodard, Emhardt, Moriarty, McNett & Henry LLP

(57) ABSTRACT

The present invention provides a tennis table that is collapsible into a relatively small profile. The table can be partially assembled in relatively small boxes for easy storage and display on store shelves and for easy shipment in commercial or customer vehicles with limited cargo space. The table can be fully assembled without tools relatively quickly. The table is capable of being opened from the collapsed configuration by young or physically disabled persons with a relatively small amount of force and has a low profile, both height and lengthwise, in the collapsed configuration In a first embodiment the collapsible tennis table comprises two table halves, each table half having two table portions and legs secured to the bottom of each table portion. Each of the legs receives a connecting member that spans the joint between two table portions.

9 Claims, 7 Drawing Sheets

U.S. PATENT DOCUMENTS

| | | | |
|---|---|---|---|
| 3,823,938 | A | 7/1974 | Unno |
| 3,827,376 | A | 8/1974 | Solomon |
| 3,830,495 | A | 8/1974 | Hill |
| 3,977,528 | A | 8/1976 | Berger |
| 4,016,819 | A | 4/1977 | Cowling |
| 4,067,266 | A | 1/1978 | Lafargue |
| 4,327,650 | A | 5/1982 | Bue |
| 4,469,029 | A | 9/1984 | Ramond |
| 4,489,661 | A | 12/1984 | Fitzgerald |
| 4,591,289 | A | 5/1986 | Vickers et al. |
| 4,763,321 | A | 8/1988 | Calvignac et al. |
| 4,911,085 | A | 3/1990 | Pencoske |
| D308,922 | S | 7/1990 | Ng et al. |
| 5,560,302 | A | 10/1996 | Diffrient et al. |
| D378,635 | S | 4/1997 | Studer et al. |
| 5,816,957 | A | 10/1998 | Dadbeh |
| 6,041,721 | A | 3/2000 | Weston |

OTHER PUBLICATIONS

SportCraft Table Tennis Table Assembly Instructions and Rules, Model 27032, 37031 and 97032.

SportCraft Table Tennis Table Assembly Instructions and Rules, Model 18-0855.

Challenger Indoor Table Tennis Table, Assembly Instructions and Owner's Manual, Model 6502, Aug. 13, 1999.

QuickServe Table Tennis Set, Packaging Slip, 6111.

Ready2Play Table Tennis Set, Information Sheet, 6019.

* cited by examiner

COMPACT COLLAPSIBLE TENNIS TABLE

This application is a continuation of application Ser. No. 09/561,884 filed May 1, 2000, now abandoned, incorporated herein by reference.

BACKGROUND OF THE INVENTION

1. Field of the Invention

The present invention relates to a collapsible tennis table which is relatively simple in construction and wherein, when folded, provides a compact unit for shipping and storage purposes.

2. Description of the Prior Art

Collapsible or foldable tables, such as hobby and game tables, and tennis tables are well known. Many of these are designed with wheels or casters to facilitate movement and to occupy smaller storage areas. In order to provide for the collapsibility feature, the prior art tables include a number of complex parts which are relatively expensive. To accommodate smaller shipping sizes, the prior tables are typically unassembled. In this case, assembly can take a number of hours and requires at least two people. Further, a large number of parts are involved in partially assembled tables. In many cases, parts such as bolts and nuts are missing or lost and customers cannot assemble a table and generally become frustrated. A frustrated customer tends to call the store from which the table is purchased or the manufacturer themselves.

To assemble the table also requires a number of tools, some of which are not available in the average household. Some manufacturers ship fully assembled tables to customers requiring substantially large packaging and higher shipping costs. For example, U.S. Pat. No. 4,911,085 discloses a collapsible table which is relatively large in size even after it is collapsed. Large assembled units are difficult to deliver to a number of dwellings with a recreation room in the basement or off an indirect hallway. At times, it is required to disassemble the table to take it to the place of intended use.

The opening and closing of the table requires a number of steps such as locking, unlocking, pushing together and pulling apart. These steps must be taken in a precise sequence. If the sequence is missed, it can cause serious injury to the user and damage property. Many of the prior art collapsible tables have a high profile and require a relatively tall person with some physical strength to open and close the table, making it difficult, it not impractical, for a young child or a chair-bound handicapped person to operate the table. There is also the inconvenience of attaching and disassembling the net and bracket on the tennis table. Although some tables leave the net and bracket attached to the table when folding and storing, the bracket extends outwardly enough to be hazardous. U.S. Pat. No. 5,816,957, issued Oct. 6, 1998 and assigned to the assignee of the present invention, discloses a collapsible tennis table which overcomes the disadvantages noted hereinabove. However, the compact tennis table disclosed in that patent utilizes a connecting, or cross, member to join parallel frame members together. The joining process requires additional parts (i.e. the cross member itself, four bolts and ring nuts) increasing the cost thereof and additional user steps to assemble the tennis table, which may lessen the marketability of the product.

What is thus desired is to provide a collapsible table which is easy to assemble, is relatively inexpensive and which enables the young person and handicapped to have access to the table.

SUMMARY OF THE PRESENT INVENTION

The present invention provides a simplified multi-section collapsible tennis table which requires a minimum of parts and when unpackaged is easy to assemble (and disassemble) without tools. The present invention provides a tennis table that is collapsible into a relatively small profile, or configuration, partially assembled for shipment or storage purposes. The table can be fully assembled without tools relatively quickly. The table is capable of being opened and closed with a relatively small amount of force and has a low profiles both height and lengthwise, in both the disassembled and operational modes. The table is configured so that it is relatively easy to be operated by a young person and physically restricted persons.

In particular, in a first embodiment the collapsible tennis table of the present invention comprises two table sections, each table section comprising first and second table portions and tubular leg members secured to the bottom (non-player) surface of each table portion. One end of each leg member is positioned to receive one end of a connecting member, the connecting member functioning to align the two table portions and to support the center of the assembled table portions. A pair of clip members are fastened to the bottom surface of each table portion and the leg member of the tubular members are releasably held against the bottom surface of each table portion thereby. In order to assemble one table section of the collapsible table of the present invention, the ends of the connecting member are inserted into the open ends of each leg member and the two table portions pushed toward each other, joining the table portions together. Safety latches are positioned on the far ends of the bottom surface of each table portion to force the table portions together and to prevent the portions from separating. When it is desired to collapse the tennis table, the safety latches are opened and the two table portions of each section are pulled apart.

Caster devices are provided and have vertically extending tubular extensions which are adapted to be inserted into the end opening of one of the leg members formed on the bottom surface of each table section. Preferably the caster devices are separate sub-assemblies without a cross-member. When joined in this manner, an assembled tennis table is provided. The casters allow the assembled tennis table to be easily moved about. When it is desired to play table tennis, each table section is moved to the horizontal position and a tennis net is then secured to the table in the manner set forth in Pat. No. 5,816,957.

In a second embodiment, the collapsible table comprises two sections joined together in a manner identical to the joining of the two table portions as described in the first embodiment set forth hereinabove. In this embodiment, the tubular leg members are rotated to a substantially vertical direction to enable the assembled tennis table to stand upright on a surface, such as a floor.

In a third embodiment, a two section tennis table, each section having a pair of leg members releasably secured to the bottom surface of the table sections, is provided. The two sections are mounted to caster devices in the same manner described hereinabove with respect to the first embodiment. In one preferred feature, as illustrated, the caster devices include two assemblies without a cross-member.

The collapsible table of the present invention is thus easy to assemble, and can be stored easily because of its low profile. The table can be quickly and easily disassembled thus making it relatively simple to transport the disassembled table to a park or other venue and to then assemble the table for play as set forth hereinabove.

DESCRIPTION OF THE DRAWING

For a better understanding of the invention as well as other objects and further features thereof, reference is made to the following description which is to be read in conjunction with the accompanying drawing wherein.

DESCRIPTION OF PREFERRED EMBODIMENTS

Figure 1A:
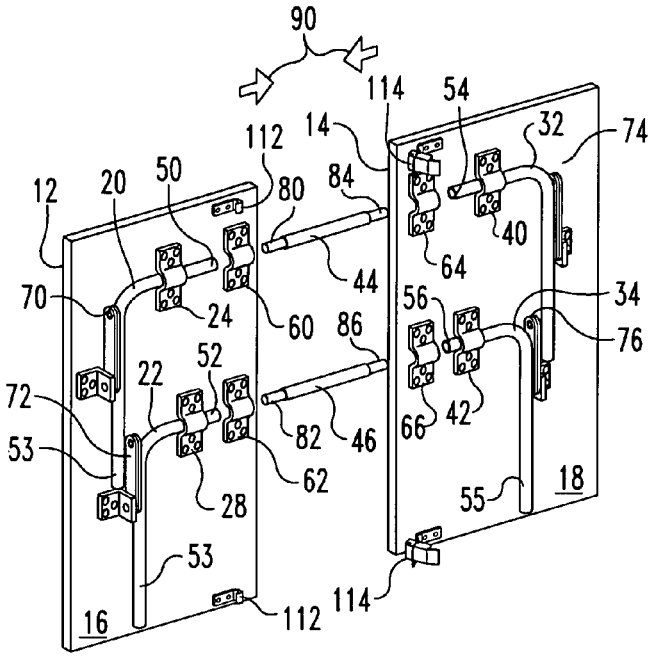
FIGS. 1(*a*)–1(*f*) are perspective views of a first embodiment of the collapsible table of the present invention in disassembled and assembled states.
Figure 1B:
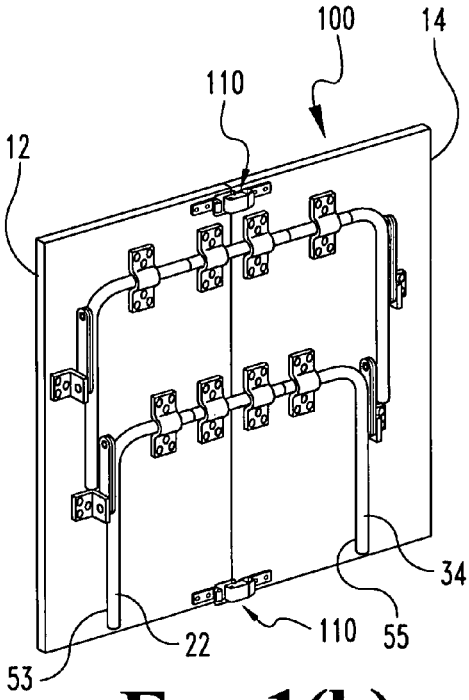
Figure 1C:
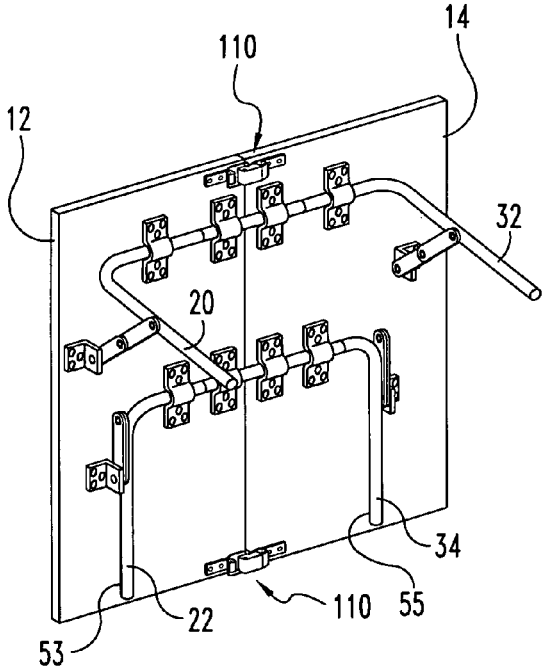
Figure 1E:
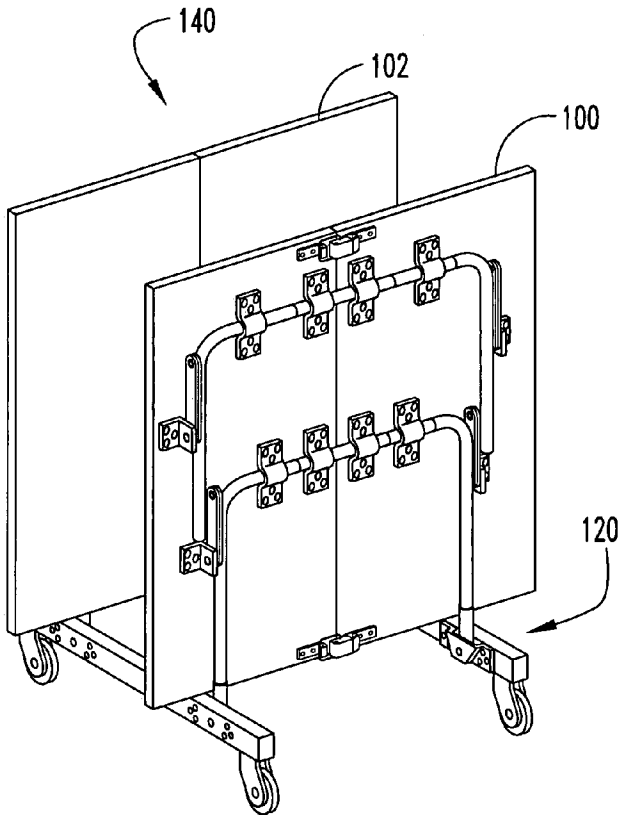
Figure 1D:
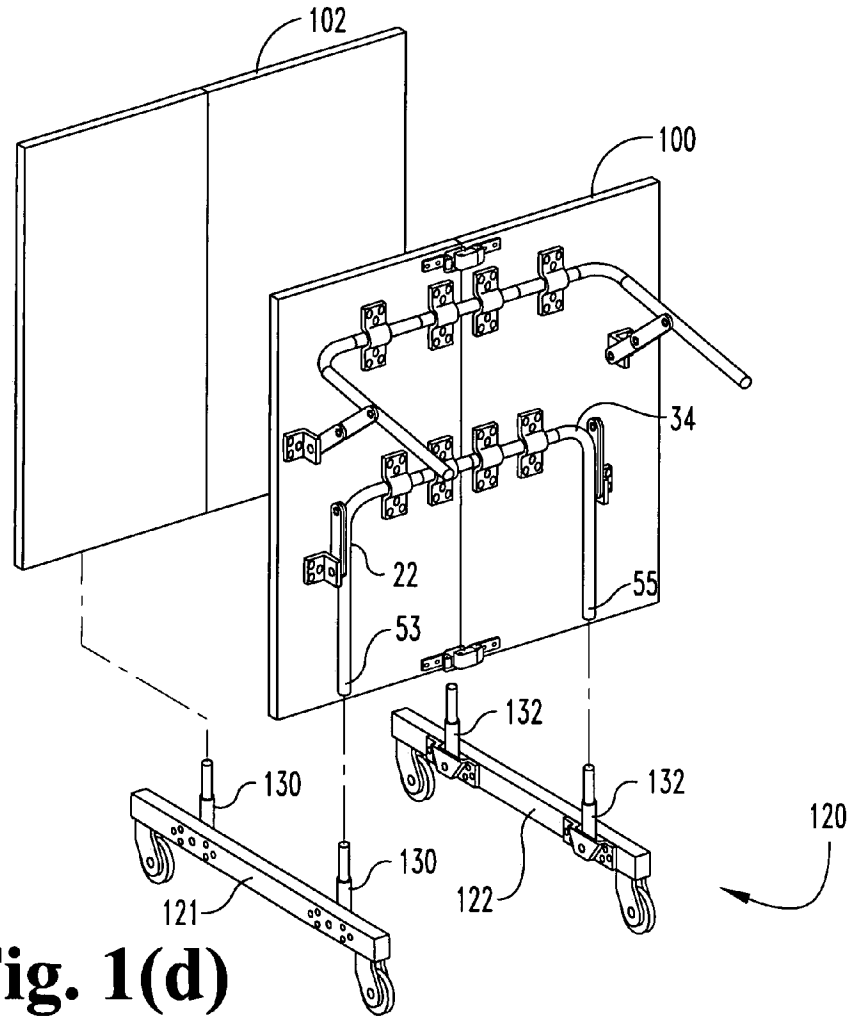
Figure 1F:
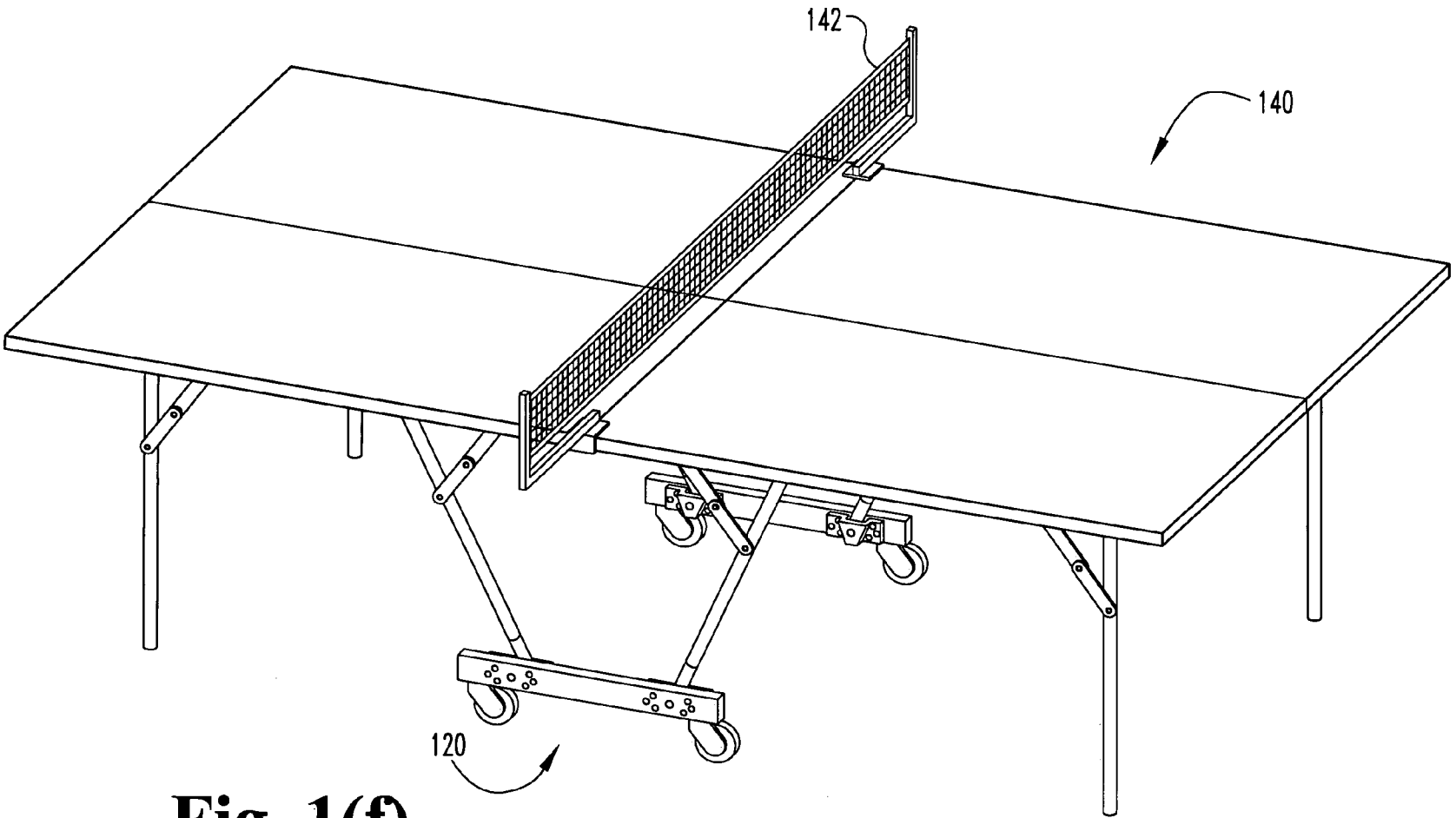
Figure 2C:
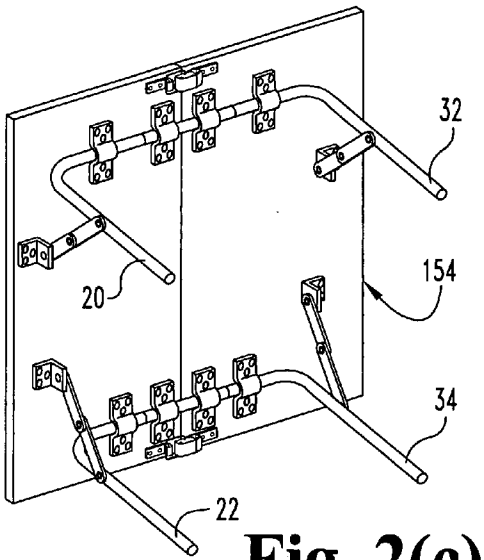
FIGS. 2(*a*)–2(*d*) are perspective views of a second embodiment of the present invention in disassembled and assembled states.
Figure 2B:
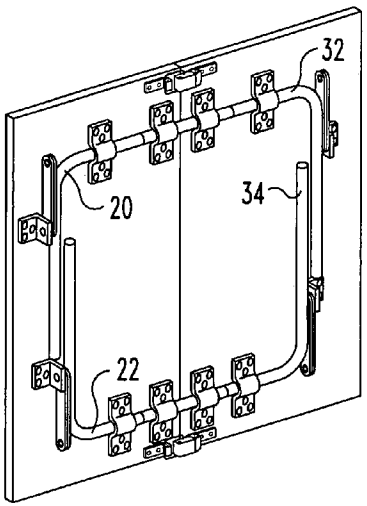
Figure 2A:
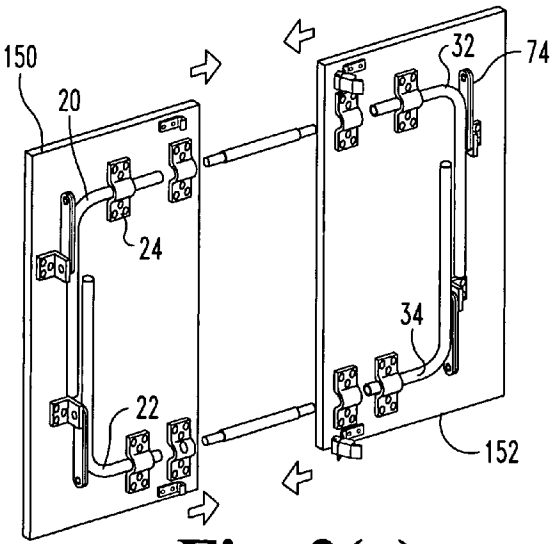
Figure 2D:
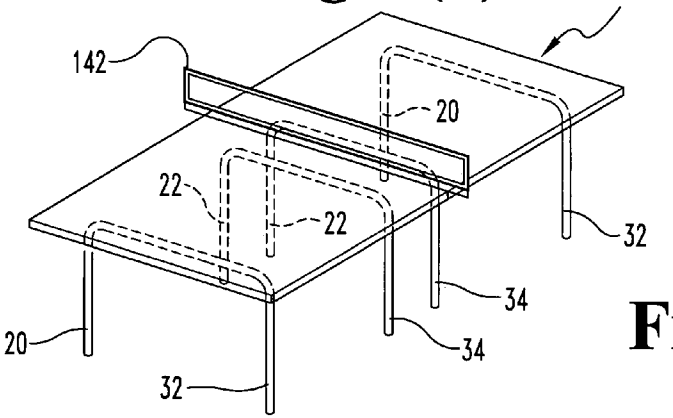

The present invention provides a simplified multi-section collapsible tennis table which requires a minimum of parts and when unpackaged is easy to assemble (and disassemble) without tools.

Referring now to FIGS. 1(*a*)–1(*f*), perspective views of the unassembled and then assembled section 100 of a collapsible tennis table 140 (FIG. 1(*f*)) of the first embodiment of the present invention are illustrated. Section 100 comprises table portions 12 and 14, each table portion having bottom surfaces 16 and 18, respectively. Secured to bottom surface 16 of table section 12 is a pair of tubular leg extensions 20 and 22, extension 20 being rotatably secured to bottom surface 16 via clip 24. Extension 22 is rotatably secured to bottom surface 16 of the table section 12 via clip 28. Secured to bottom surface 18 of table section 14 is a pair of tubular leg extensions 32 and 34, extension 32 rotatably secured to bottom surface 18 via clip 40, extension 34 being rotatably secured to bottom surface 18 via clip 42. Extensions 20, 22, 32 and 34 have end portions 50, 52, 54 and 56 as illustrated, end portion 50 being positioned adjacent bracket 60 secured to surface 16, end portion 52 being positioned adjacent to bracket 62 secured to surface 16, end portion 54 being positioned adjacent bracket 64 secured to surface 18 and end portion 56 being positioned adjacent bracket 66 secured to surface 18.

Figure 4:
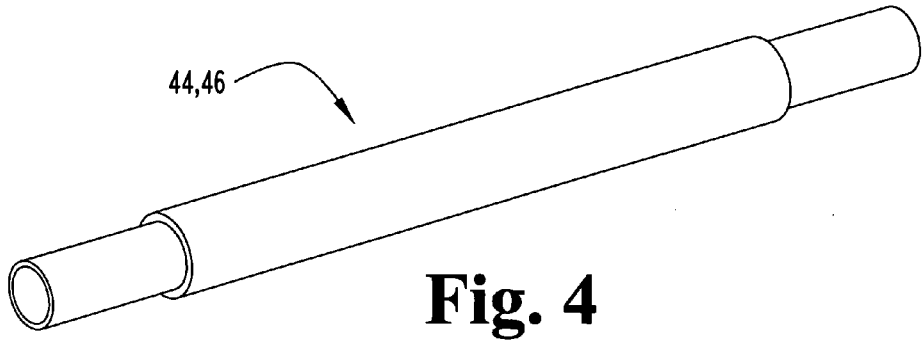
FIG. 4 is a perspective view of the connecting device utilized in the present invention; and latch utilized in the present invention.

A pair of connecting members 44 and 46 are positioned between table portions 12 and 14, connecting member 44 positioned adjacent brackets 60 and 64 as illustrated, and connecting member 46 being positioned adjacent brackets 62 and 66 as illustrated. Connecting members 44 and 46 (FIG. 4) preferably comprise tubing 49 having two reduced end portions 80, 82, 84 and 86 sized to fit into the ends of the adjacent tubular leg extension members.

Extendable leg support braces 70, 72, 74 and 76 are connected to legs 20, 22, 32 and 34. respectively, in a conventional manner and enable the legs to be rotated to their vertical positions.

FIGS. 1(*a*)–(*e*) show the components of tennis table 140 as would be found in the packaging carton and prior to assembly. The tennis table section 100 is assembled as follows:

1. The components are removed from the shipping carton and table portions 12 and 14 are preferably laid flat on a horizontal surface.

2. End 80 of connecting member 44 is inserted into end 50 of extension 20 through bracket 60; end 82 of connecting member 46 is inserted into end 52 of extension 22 through bracket 62.

3. Table section 14 is then moved adjacent ends 84 and 86 of connecting members 44 and 46, respectively, in a manner such that those ends 84 and 86 are inserted into the adjacent openings 54 and 56 of extensions 32 and 34 via brackets 64 and 66, respectively.

4. Force is then applied to the edges of table sections 12 and 14 in the direction of the arrows 90 whereby connecting members 44 and 46 engage the holes (openings) formed in the ends of extension legs 20, 22, 32 and 34 thus forming an assembled tennis section 100 as shown in FIG. 1(*b*).

5. In preparation for joining table section 100 to the caster device 120 shown in FIGS. 1(*d*)–1(*f*), leg extensions 20 and 32 (now joined together) are rotated away from the bottom surfaces of table sections 12 and 14, respectively, as shown in FIG. 1(*c*) whereas leg extensions 22 and 34 are maintained in their folded positions.

Figure 5A:
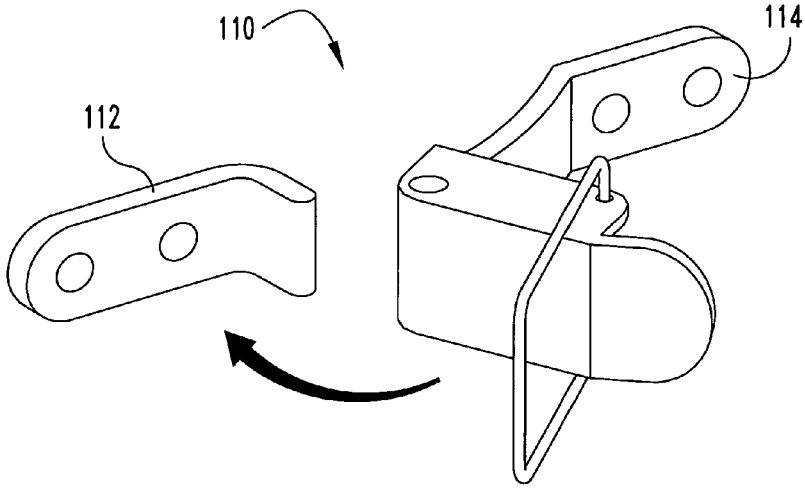
FIGS. 5(*a*)–5(*b*) are perspective views of a latch assembly used with preferred embodiments of the present invention, such as the first embodiment illustrated in FIGS. 1(*a*)–1(*f*).
Figure 5B:
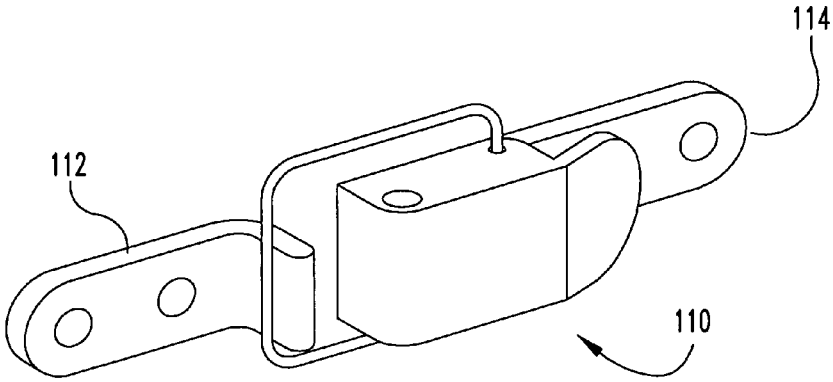

In order to prevent the assembled tennis section from separating, a latch assembly 110, shown in more detail in FIGS. 5(*a*) and 5(*b*), and comprising post member 112 and latching member 114 is secured to the bottom surface 16 and 18 of table portions 12 and 14, respectively, as illustrated. After the table portions 12 and 14 are joined to form section 100, the latches are joined together in a conventional manner, forcing portions 12 and 14 securely together and preventing them from separating. Table section 102, shown in FIGS. 1(*d*)–1(*f*) is formed in an identical manner as section 100.

FIGS. 1(*d*) and 1(*e*) illustrate how the two assembled table sections 100 and 102 are joined to a device 120 having four (4) casters enabling the assembled table 140 to be moved to a desired position. Device or wheelbase 120 preferably includes two elongate caster base members 121 and 122, each having casters, enabling the assembled table 140 to be moved to a desired position. Vertical tubular extensions 130 and 132 are mounted to elongate members 121 and 122. Specifically, the end portions 53 and 55 of leg extensions 22 and 34, respectively, receive vertical tubular extensions 130 and 132, thus integrally joining the two table sections 100 and 102 together as shown in FIG. 1(*e*). In an alternate embodiment (not shown), end portions of 53 and 55 of leg members 22 and 34 are inserted into vertical tubular extensions 130 and 132. The assembled tennis table 140 is then produced by moving the two table sections 100 and 102 to the horizontal position shown in FIG. 1(*f*), tennis table 140 being shown with a tennis net 142 secured thereto as illustrated. The assembly steps shown in FIGS. 1(*d*)–1(*f*) are basically described in U.S. Pat. No. 5,816,957 (other than the use of a cross-member connecting the elongate base members), of which the necessary teachings for an understanding of the present invention are incorporated herein by reference. As a preferred feature of the present invention, the cross-member 38 described in U.S. Pat. No. 5,816,957 is unnecessary, reducing the materials needed and the assembly time of the table.

Latch assembly 110 is conventional.

The second embodiment of the present invention shown in FIGS. 2(*a*)–2(*d*) is different to that shown in FIGS. 1(*a*)–1(*c*) to the extent that the extendible leg portions 20, 22, 32 and 34 of the table portions 150 and 152, when joined together to form one section of tennis table 154 (the same reference numerals are used in each figure to identity identical components), are rotated to their full vertical positions so that tennis table 154 can be positioned directly on a substantially flat surface, such as a floor without the use of device 120. The second table section (FIG. 2(*d*)) is then positioned adjacent the first table section, are the sections are joined together in a conventional manner to complete the assembly of tennis table 154.

Figure 3B:
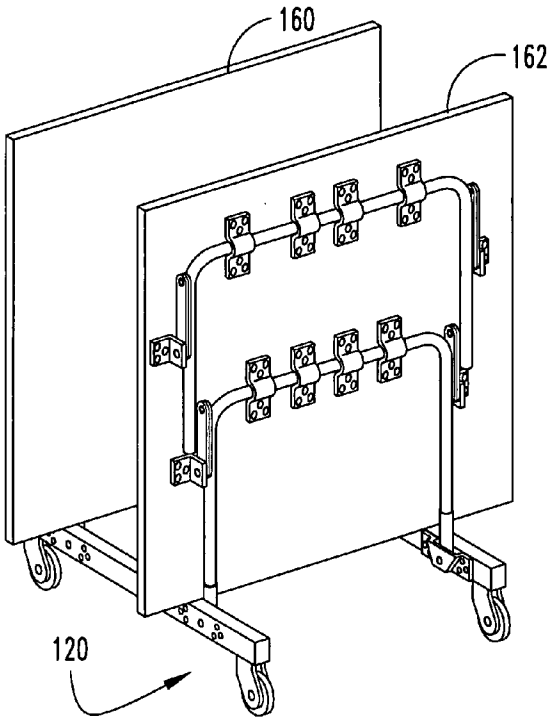
FIGS. 3(*a*)–3(*c*) are perspective views of a third embodiment of the present invention in the disassembled and assembled states.
Figure 3A:
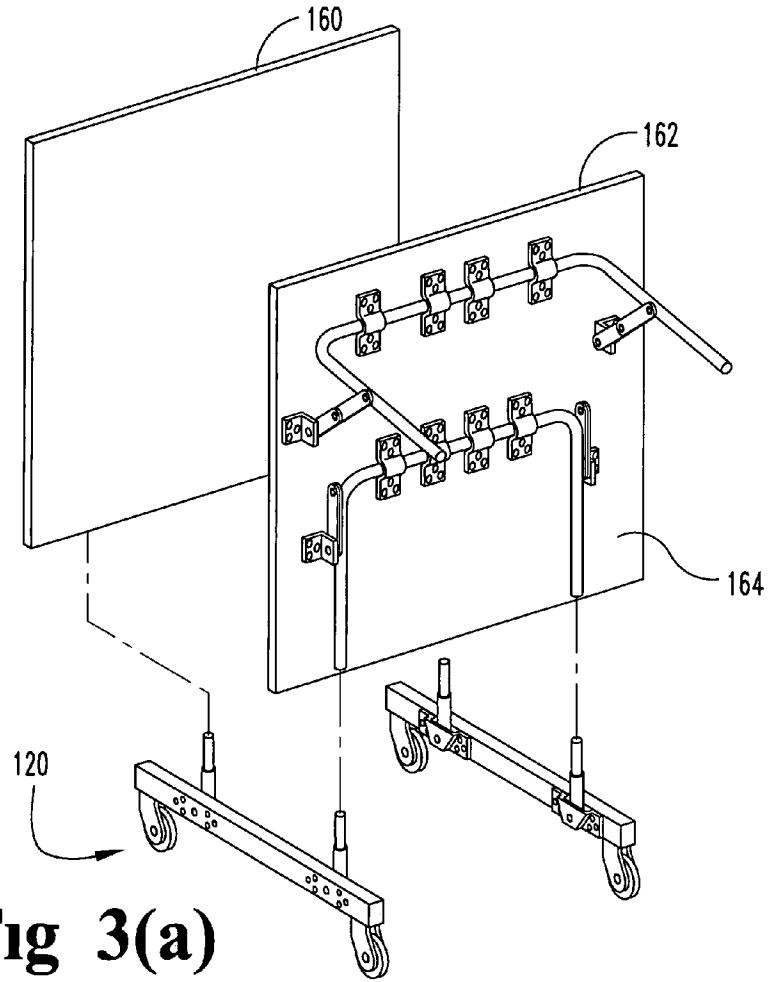
Figure 3C:
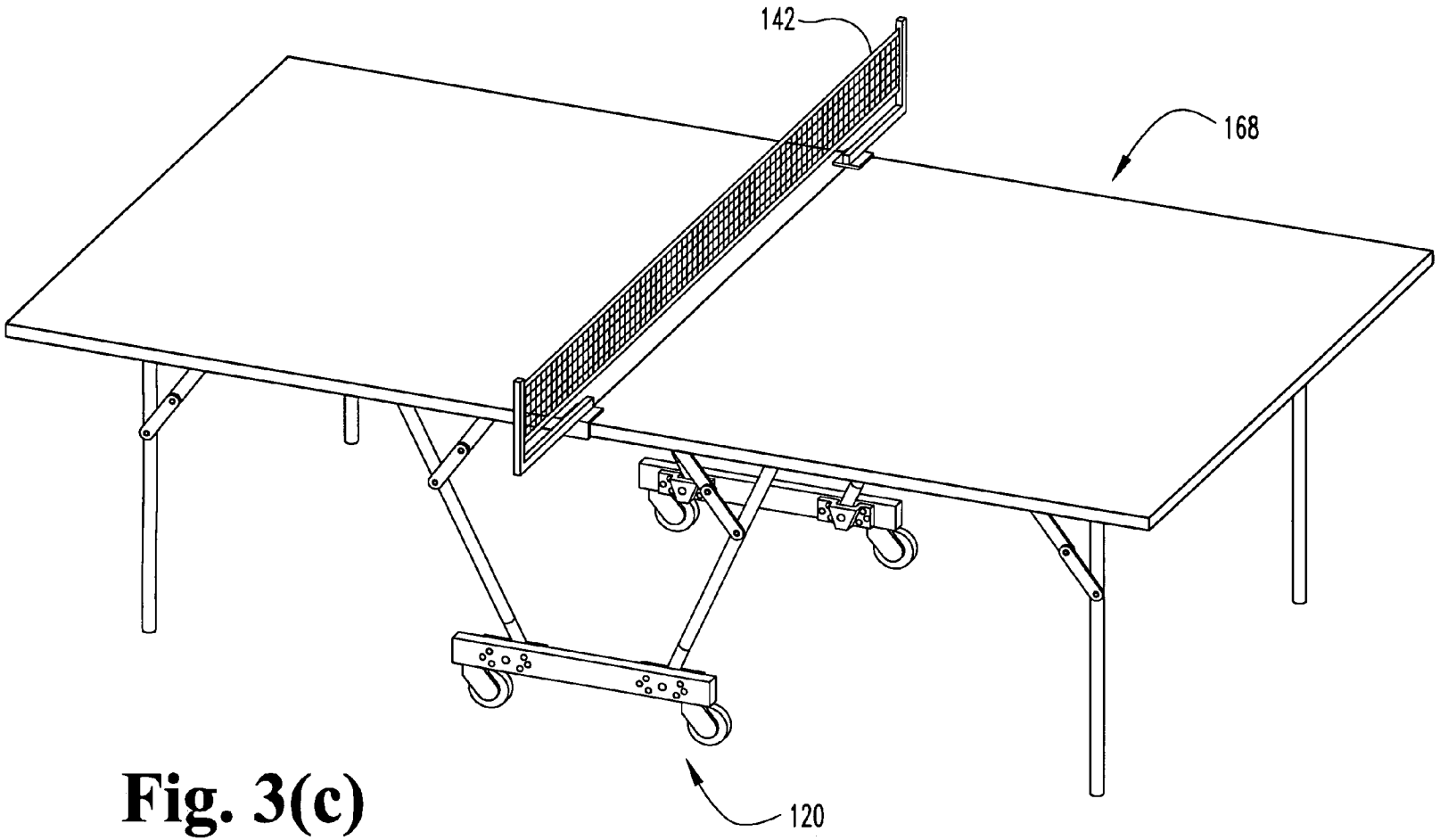

A third embodiment of the present invention, shown in FIGS. 3(*a*)–3(*c*) is different than that shown in FIGS. 1(*a*)–1(*c*) to the extent that the table sections 160 and 162 are each fabricated as single pieces with the extendible leg portions secured on the bottom surface (only surface 164 illustrated). Each table section 160 and 162 is connected to the caster subassemblies 120 as described with reference to FIGS. 1(*d*) and 1(*e*), and then unfolded to form tennis table 168 as shown in FIG. 3(*c*). As previously discussed, the wheelbase does not require a cross-member between the caster subassemblies.

The present invention thus provides a compact, collapsible tennis table which is easy to assemble and disassemble without tools and wherein the disassembled tennis table can be easily stored and shipped.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A multi-section table tennis table having an improved leg structure, comprising:

a) first and second table portions arranged to abut to form a table tennis table half, each portion having a lower surface;

b) a first leg member having a diameter and at least one open end, wherein said first leg member is secured to the lower surface of said first table portion;

c) a second leg member having a diameter substantially equal to the diameter of said first leg member and at least one open end, wherein said second leg member is secured to the lower surface of said second table portion;

d) a connecting member positioned adjacent said lower surfaces of said first and second table portions and spanning the abutment between said first and second table portions;

e) wherein said connecting member has a central portion with a diameter substantially equal to the diameter of said first and second leg members and wherein said connecting member has first and second end portions, wherein said first end portion has a reduced diameter received within an open end of said first leg member and wherein said second end portion has a reduced diameter received within an open end of said second leg member; and, f) wherein said central portion of said connecting member contacts said lower surfaces of said first and second table portions, and wherein said central portion supports the abutment between said first and second table portions.

2. The table tennis table of claim 1 wherein said leg members and said connecting member are tubular.

3. The table tennis table of claim 2 further comprising at least one bracket secured to each of said first and second table portions, wherein said brackets are configured to receive said connecting member and retain said central portion of said connecting member in contact with said lower surface of said first and second table portions respectively.

4. The table tennis table of claim 2 further comprising an attachment mechanism mounted adjacent said abutment to secure said first table portion to said second table portion.

5. The table tennis table of claim 1, further comprising:

a) third and fourth leg members respectively secured to the lower surface of said first and second table portions;

b) a second connecting member positioned adjacent said lower surfaces of said first and second table portions and spanning the abutment between said first and second table portions; and, c) wherein said second connecting member has a central portion with a diameter substantially equal to the diameter of said third and fourth leg members and wherein said second connecting member has first and second end portions, wherein said first end portion has a reduced diameter received within an open end of said third leg member, wherein said second end portion has a reduced diameter received within an open end of said fourth leg member, and, wherein said central portion of said second connecting member contacts said lower surfaces of said first and second table portions and supports the abutment between said first and second table portions.

6. A multi-section table tennis table having an improved leg structure, comprising:

a) first and second table portions arranged to abut to form a table tennis table half, each portion having a lower surface;

b) a first leg member having a primary diameter, wherein said first leg member is secured to the lower surface of said first table portion;

c) a second leg member having a primary diameter, wherein said second leg member is secured to the lower surface of said second table portion;

d) a connecting member positioned adjacent and contacting said lower surfaces of said first and second table portions and supporting the abutment between said first and second table portions, wherein said connecting member has a central portion with a primary diameter substantially equal to the primary diameters of said first and second leg member; and, e) wherein at least one of said leg members and said connecting member has an end portion with a reduced diameter which is received in fitted engagement within an open end in the other one of said members.

7. The table tennis table of claim 6 wherein said leg members and said connecting member have a round diameter.

8. The table tennis table of claim 6 further comprising at least one bracket secured to each of said first and second table portions, wherein said brackets are configured to receive the primary diameter of said connecting member and retain said connecting member in contact with said lower surface of said first and second table portions respectively.

9. A multi-section table tennis table which when assembled has table halves movable between stowed and playing positions, comprising:

a) four table portions, wherein said table portions are joinable to form first and second table halves of a table tennis table, each table half having first and second table portions;

b) a plurality of leg members securable to said table portions, each leg member having a primary diameter;

c) a plurality of connecting members having a central portion with a diameter substantially equal to the primary diameter of said leg members, d) wherein each connecting member has first and second end portions, wherein said first end portion has a reduced diameter configured to be within received within an opening in a leg portion securable to the first table portion of a table half, and wherein said second end portion has a reduced diameter configured to be received within an opening in a leg portion securable to the second table portion of a table half, and wherein each said central portion is configured to support the joint between two table portions of a table half;

e) two caster base members, each caster base member connectable to a leg member securable to said first table half and to a leg member securable to said second table half;

f) wherein for each connection of a leg member to a caster base member, one of each leg member and each caster base member defines at least one opening and the other of said leg member and said caster base member has a reduced diameter end portion, wherein the leg member is connectable to the caster base member by inserting the reduced diameter end portion into said opening; and, g) a plurality of casters attachable to said caster base members.

* * * * *